US010309641B1

(12) United States Patent
Daly

(10) Patent No.: US 10,309,641 B1
(45) Date of Patent: Jun. 4, 2019

(54) METHODS AND SYSTEMS FOR INDICATING AN EXERCISE FOOTPRINT

(71) Applicant: Brunswick Corporation, Lake Forest, IL (US)

(72) Inventor: Juliette C. Daly, Arlington Heights, IL (US)

(73) Assignee: Brunswick Corporation, Mettawa, IL (US)

( * ) Notice: Subject to any disclaimer, the term of this patent is extended or adjusted under 35 U.S.C. 154(b) by 331 days.

(21) Appl. No.: 14/719,865

(22) Filed: May 22, 2015

(51) Int. Cl.
*F21V 33/00* (2006.01)
*F21Y 101/02* (2006.01)

(52) U.S. Cl.
CPC ..... *F21V 33/008* (2013.01); *A63B 2207/00* (2013.01); *A63B 2207/02* (2013.01); *F21Y 2101/02* (2013.01); *F21Y 2101/025* (2013.01)

(58) Field of Classification Search
CPC ..... F21V 33/008; A63B 22/0664; E06B 3/90; E06B 3/903
See application file for complete search history.

(56) References Cited

U.S. PATENT DOCUMENTS 6,084,325 A 7/2000 Hsu
6,095,952 A * 8/2000 Ali ..... A63B 22/02 482/35
6,626,804 B2 * 9/2003 Wang ..... A63B 21/0051 482/63
7,479,093 B1 1/2009 Immordino et al.
7,717,833 B1 5/2010 Nelson et al.
7,931,566 B1 4/2011 Radke et al.
8,206,002 B1 * 6/2012 Olson ..... B25H 5/00 280/32.6
8,272,997 B2 9/2012 Anderson et al.
8,337,060 B1 * 12/2012 Frankovich ..... B60Q 1/326 315/76
2004/0259689 A1 * 12/2004 Wilkins ..... A63B 5/00 482/8
2008/0022596 A1 * 1/2008 Boerger ..... E06B 9/82 49/31
2008/0219014 A1 * 9/2008 Loibl ..... B62J 6/00 362/473
2008/0312045 A1 * 12/2008 Lull ..... A63B 22/0015 482/52
2010/0093492 A1 * 4/2010 Watterson ..... A63B 22/0242 482/4
2011/0275482 A1 * 11/2011 Brodess ..... A63B 21/0428 482/8
2017/0056717 A1 * 3/2017 Ercanbrack ..... A63B 22/0664

FOREIGN PATENT DOCUMENTS

DE 202013100464 * 3/2013 ..... A63B 22/0235

OTHER PUBLICATIONS

English Machine Translation of DE 202013100464 from ESPACENET.*

* cited by examiner

*Primary Examiner* — Zheng Song
(74) *Attorney, Agent, or Firm* — Andrus Intellectual Property Law, LLP

(57) ABSTRACT

A method of indicating an exercise footprint includes providing an exercise assembly having at least one exercise member that moves within the exercise footprint and controlling at least one illumination source to illuminate a floor surface to indicate at least a portion of the exercise footprint.

19 Claims, 5 Drawing Sheets

METHODS AND SYSTEMS FOR INDICATING AN EXERCISE FOOTPRINT

FIELD

The present disclosure relates to exercise assemblies.

BACKGROUND

U.S. Pat. No. 6,084,325, which is incorporated herein by reference in entirety discloses a resistance device with a combination of power-generating and eddy-current magnetic resistance having an outer fly wheel fastened on a central axle of a frame and fitted with a permanent magnet on the inner circular edge to form a rotor type, and the fly wheel is connected with a stator core fastened on the frame; more, one end of the central axle is stretching out of the frame and fitted with a belt wheel; the front end of the frame is fitted with a resistance device core adjacent to the outer edge of the fly wheel to supply a planned eddy current magnetic resistance to the fly wheel; in accordance with such design, the device generates power by means of the exercise force of users to drive the fly wheel to rotate, after passing through a DC power supply, it provides display and controlling gage with power source so that the power-generating and the eddy current magnetic resistance are integrated to reach the effect of reducing the volume and the producing cost.

U.S. Pat. No. 7,479,093, which is incorporated herein by reference in entirety discloses exercise apparatus having a pair of handles pivotally mounted on a frame and guiding respective user arm motions along swing paths obliquely approaching the sagittal plane of the user.

U.S. Pat. No. 7,931,566, which is incorporated herein by reference in entirety, discloses exercise apparatus, which may be an elliptical cross trainer, having a rotating inertial flywheel driven by user-engaged linkage exercising a user. A user-actuated resistance device engages and stops rotation of the flywheel upon actuation by the user.

U.S. Pat. No. 8,272,997, which is incorporated herein by reference in entirety, discloses a dynamic link mechanism in an elliptical step exercise apparatus that can be used to vary the stride length of the machine. A control system can also be used to vary stride length as a function of various exercise and operating parameters such as speed and direction as well as varying stride length as a part of a preprogrammed exercise routine such as a hill or interval training program. In addition the control system can use measurements of stride length to optimize operation of the apparatus.

U.S. Pat. No. 7,717,833, which is incorporated herein by reference in entirety, discloses adjustable exercise machines, apparatuses, and systems. The disclosed machines, apparatuses, and systems typically include an adjustable, reversible mechanism that utilizes pivoting arms and a floating pulley. The disclosed machines, apparatuses, and systems typically are configured for performing pushing and pulling exercises and may provide for converging and diverging motion.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, a method of indicating an exercise footprint includes providing an exercise assembly having at least one exercise member that moves within the exercise footprint and controlling at least one illumination source to illuminate a floor surface to indicate at least a portion of the exercise footprint.

One embodiment of a system for indicating an exercise footprint includes an exercise assembly having a frame and at least one exercise member that moves within an exercise footprint, wherein the exercise footprint extends outside of a footprint of the frame. The system also includes an illumination source that illuminates a floor surface to indicate at least a portion of the exercise footprint.

BRIEF DESCRIPTION OF THE DRAWINGS

Examples of systems and methods of the present disclosure are described with reference to the following drawing figures. The same numbers are used throughout the drawing figures to reference like features and components.

DETAILED DESCRIPTION OF THE DRAWINGS

In the present description, certain terms have been used for brevity, clearness, and understanding. No unnecessary limitations are to be inferred therefrom beyond the requirement of the prior art because such terms are used for descriptive purposes only and are intended to be broadly construed. The different assemblies described herein may be used alone or in combination with other apparatuses. Various equivalents, alternatives, and modifications are possible within the scope of the appended claims.

Figure 1:
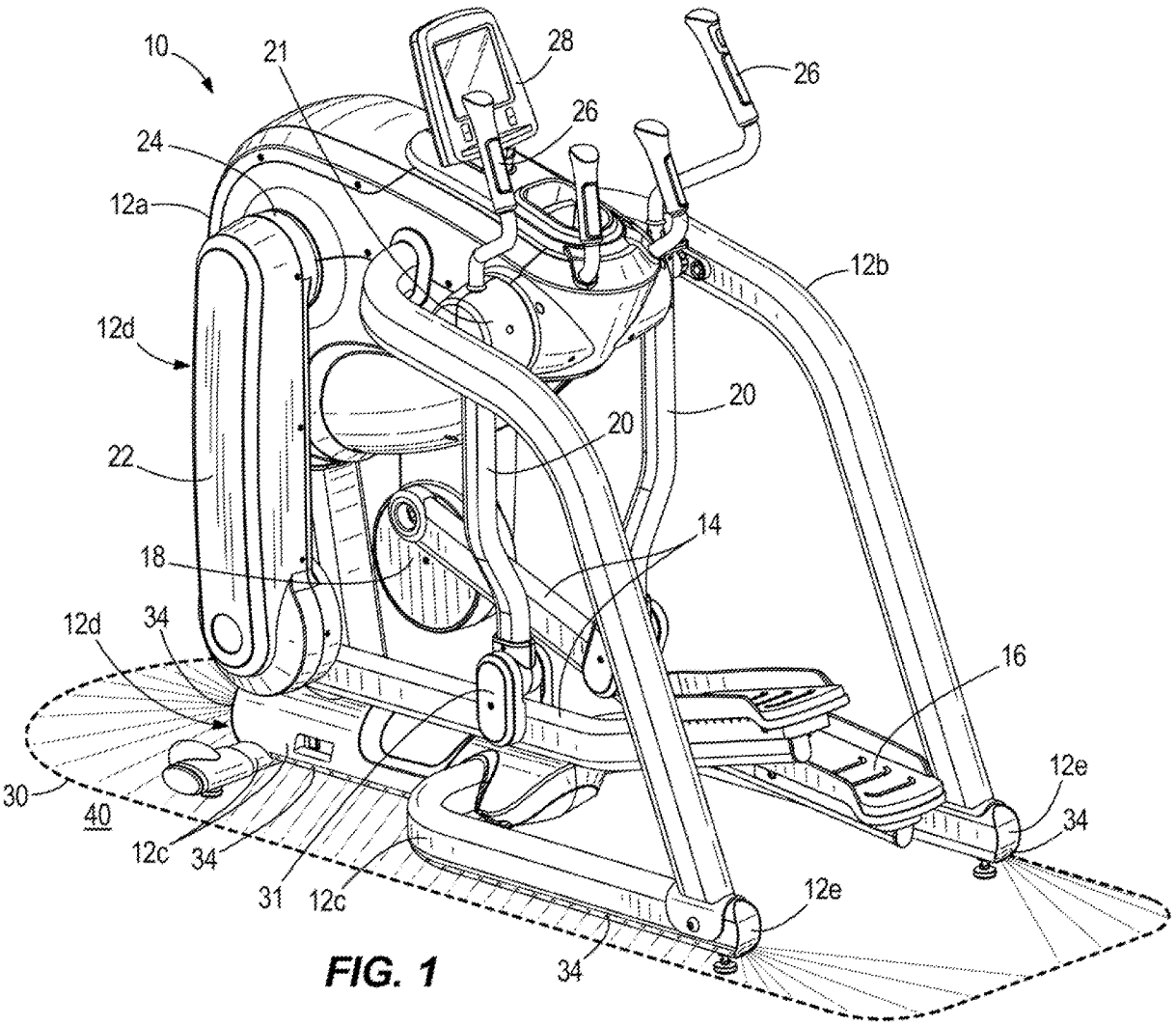
FIG. 1 is a perspective view of an exercise assembly incorporating the disclosed systems and methods.
Figure 2:
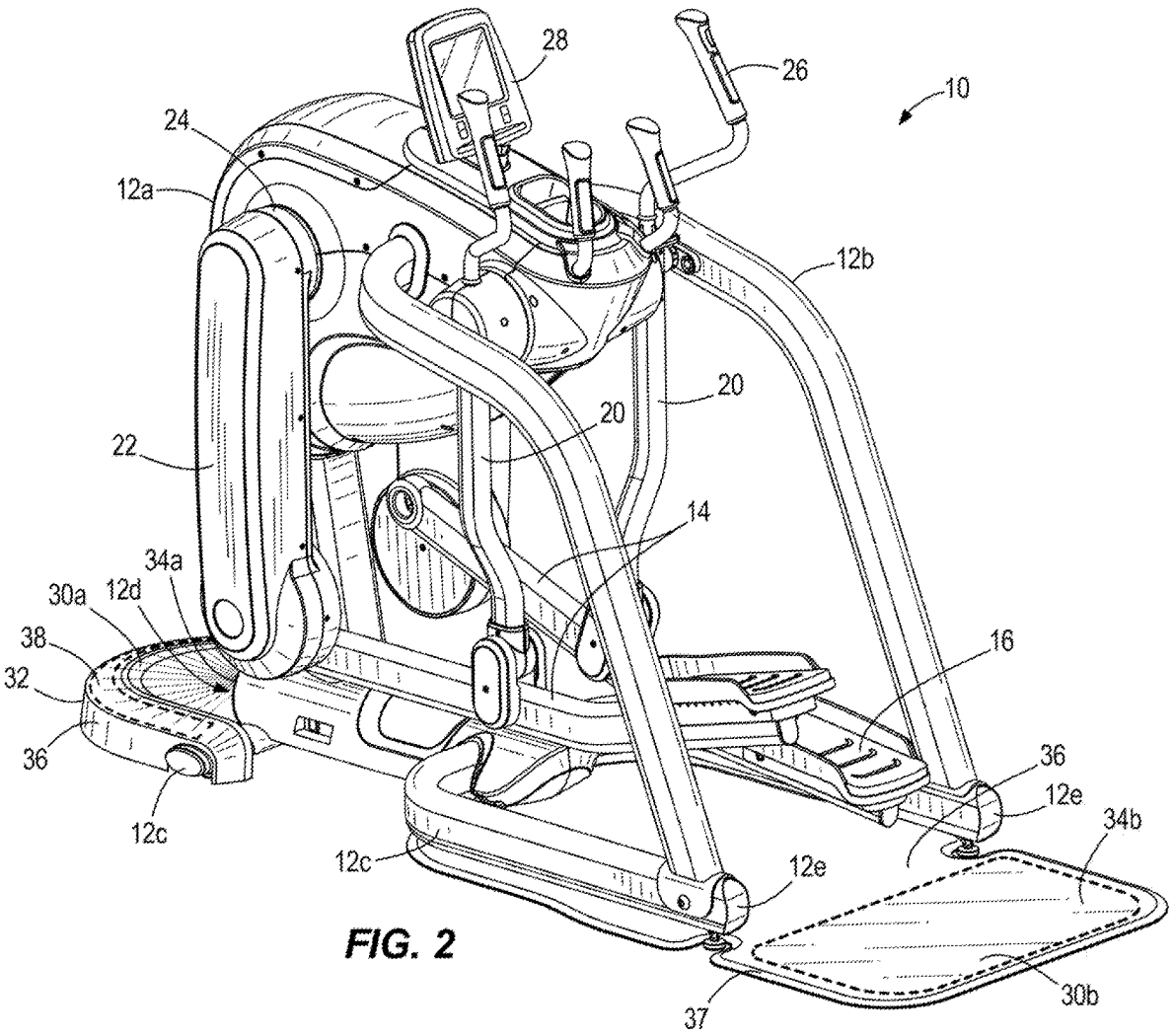
FIG. 2 is another perspective view of an exercise assembly incorporating another embodiment of systems and methods disclosed herein.
Figure 3:
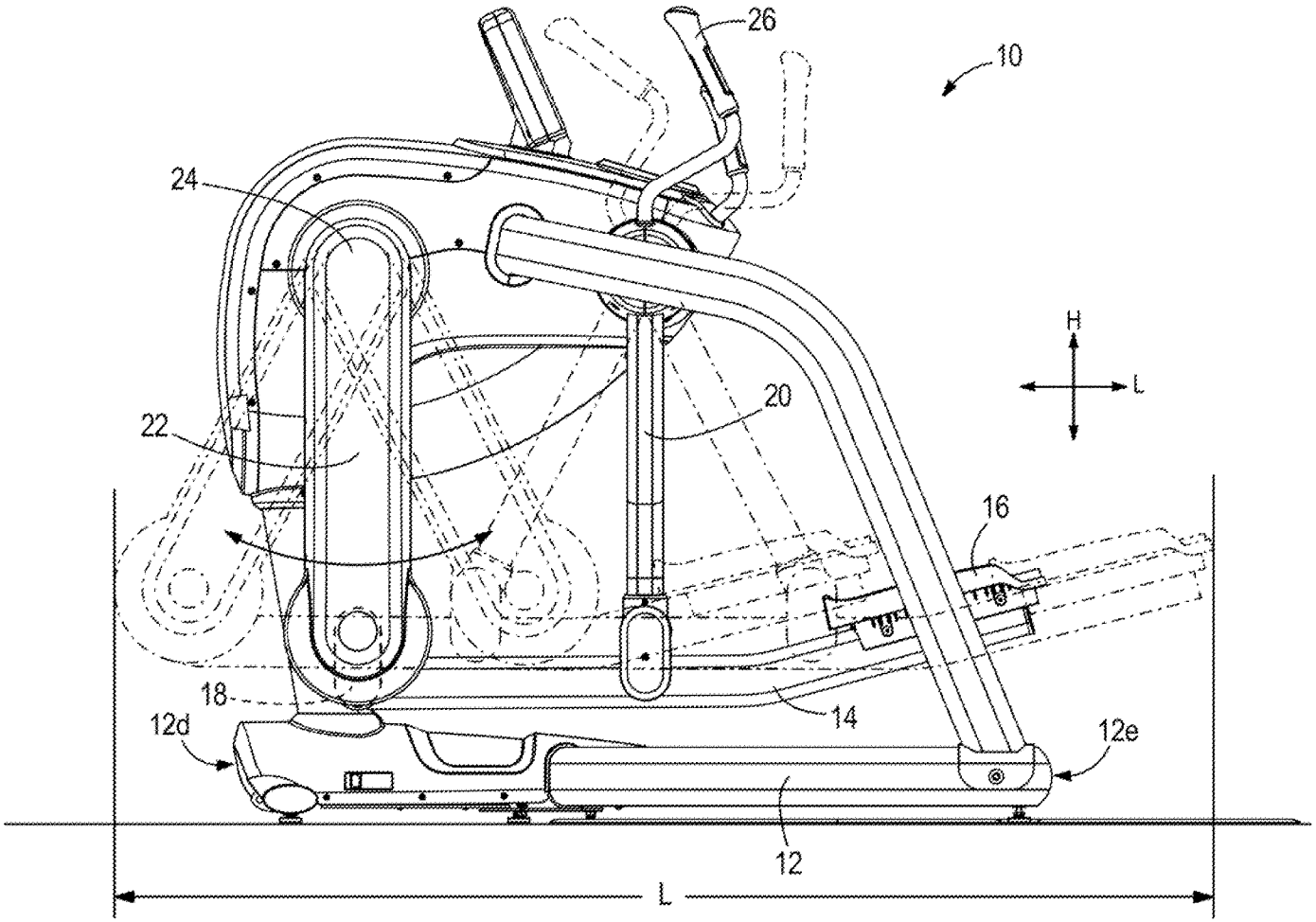
FIG. 3 is a side view of an exercise assembly demonstrating concepts disclosed herein.

FIGS. 1-3 depict one example of an exercise assembly 10 having a frame 12, including 12*a*-12*e*, a pair of elongated foot pedals 14, a pair of elongated coupler arms 22, a pair of crank members 18, and a pair of elongated rocker arms 20. The elongated foot pedals 14, coupler arms 22, and rocker arms 20 are all pivotally connected such that movement of the elongated foot pedals 14 in an elliptical motion cause the rocker arms 20 to pivot back and forth, and vice versa. Each elongated foot pedal 14 has a pair of foot pads 16 for supporting a user's feet. Each foot pad 16 is disposed on a rear portion of each one of the pair of elongated foot pedals 14. Each rocker arm 20 has a lower portion that is pivotally connected to one of the pair of elongated foot pedals 14 at a location that is between the foot pad 16 and the crank member 18. Any suitable type of pivotal connection can be employed. In this example, a connection member 31 extends vertically upwardly from the elongated foot pedal 14 and pivotally connects a lower portion of the rocker arm 20 to the elongated foot pedal 14.

The exercise assembly 10 has a frame 12, including portions 12*a*-12*e*, that provides structural stability to the assembly 10. The frame 12 has a front portion 12*a*, side portions 12*b*, and a bottom portion 12*c*. The frame 12 also has a front end 12*d*, being the front-most portion of the frame 12, and a back end 12*e*, which is the back-most portion of the frame 12. Each rocker arm 20 has an upper portion that is directly or indirectly pivotally connected to the front portion 12*a* of the frame at the pivotal joint 21. The manner of pivotal connection to the front frame portion 12*a* can vary. Handles 46 are disposed on a top end of each of the pair of rocker arms 20 and extend upwardly. The pivotal connection between the front frame portion 12*a* and the rocker arms 20 is such that movement of either handle 46 in a forward or backward motion causes both rocker arms 20 to pivot about joint 21. The pivot joints 21 of each of the rocker arms 20 are connected such that the pivoting movement of each rocker arm 20 is translated to the other rocker arm 20 via link members. The front frame portion 12*a* also connects to the top end of the coupler arm 22 via pivot joint 24. The bottom end of each coupler arm 22 connects to one of the elongated foot pedals 14 via crank member 18.

Figure 4:
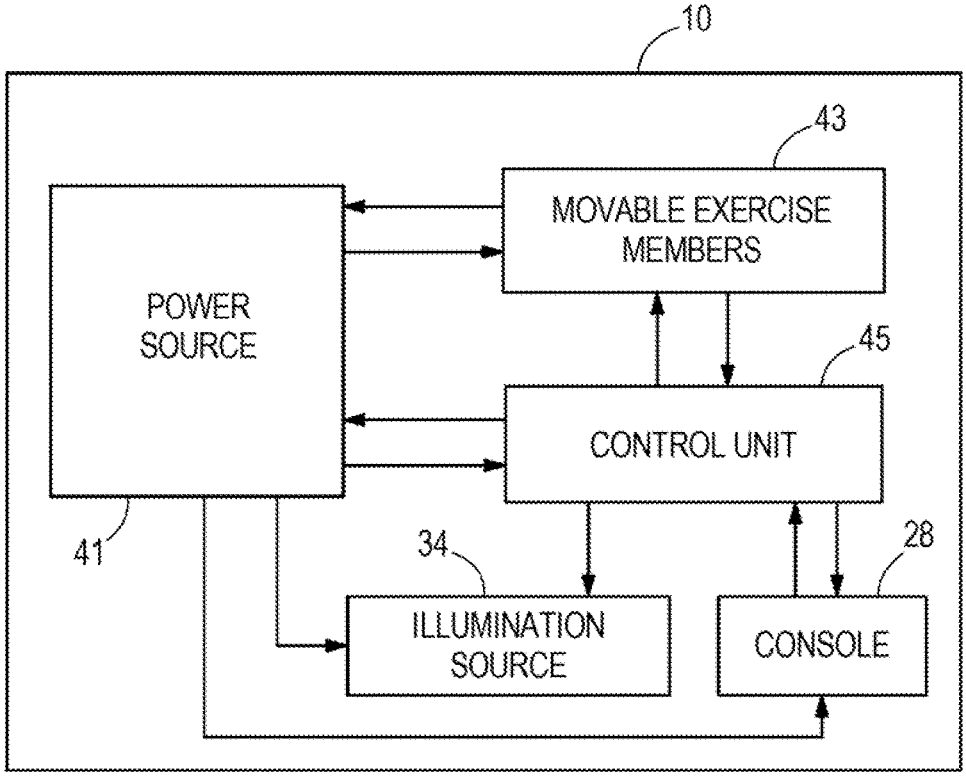
FIG. 4 is a diagram providing one embodiment of a system for indicating an exercise footprint.

The exercise assembly 10 may further comprise a console 28 allowing a user to input controls to the control unit 45 and/or to display exercise information and/or entertainment to the user. As shown more generally in FIG. 4, an exercise assembly 10 may include movable exercise members 43 movable by a user to provide a fitness activity for that user. The exercise assembly 10 may further comprise a power source 41 connected to the exercise members 43, a control unit 45, an illumination source 34, and a console 28. The control unit 45 may control the exercise members 43, for example to increase or limit the motion of the exercise members 43 or to increase or decrease the tension applied to the exercise members 43.

Referring again to the exemplary embodiment of FIGS. 1-3, the frame portions 12*a*-12*e* of the exercise assembly 10 generally surround at least a portion of an exercise area occupied by a user operating the exercise assembly 10. For example, a user standing on the foot pads 16 and grasping the handles 26 to operate the exercise assembly 10 may be conducting most of their motion within the confines of the side frame portions 12*b* and the front and back frame ends 12*d*, 12*e*. However, as with many types of exercise assemblies 10, some portion of the user's motion and or some portion of the exercise assembly 10 may extend outside of one or more of the frame portions 12*a*-12*e*. Thereby, the footprint of the exerciser's motion and or the motion of the exercise assembly, or the floor surface occupied or covered by the 3-dimensional motion, extends outside of a footprint of the frame 12. For example, when the exercise assembly 10 of FIGS. 1-3 is in use, the foot pads 16 may alternately extend past the back frame end 12*e*. Likewise, the legs and back side of a user standing on the foot pads 16 may also extend past the back frame end 12*e*. Similarly, the coupler arm 22, crank member 18, and/or the front portion of the elongated foot pedal 14 may extend past the front frame end 12*d*.

Similarly, in other embodiments of exercise assemblies the user's exercise motion and/or an exercise member of the exercise assembly may extend well outside some or all portions of the frame of that exercise assembly. To provide additional examples, a user of a row machine may extend their arms past side frame portions of the row machine and the user's head and shoulders may extend past a back end of the frame of the row machine. Likewise, skier assemblies may have ski boards that, when in use, extend beyond the front and/or back ends of a frame of the skier. Furthermore, use of exercise assemblies involving weight lifting may require motion that extends beyond the footprint of the frame, such as in cable motion weight lifting assemblies where cable travel may be extensive.

The present inventor has recognized that problems may arise where use of an exercise assembly causes exercise members and/or the user's body to extend outside of a footprint of a frame of the exercise assembly. For example, a passerby that ventures too close to the exercise assembly could get hit by a moving exercise member 43 of the exercise assembly, such as the coupler arm 22 or the foot pads 16 of the exemplary exercise assembly 10 in FIGS. 1-3. Likewise, the passerby could get hit by the user exercising on the exercise assembly 10. This can be hazardous for the passerby and the user. Furthermore, the inventor has recognized that problems can arise where exercise assemblies 10 are placed too close together or too close to an obstacle, where insufficient room is provided for safe use of the exercise assembly 10. For example, if exercise assemblies are installed based on the footprint of a frame 12 without consideration of the full range of motion of the user and of the exercise members comprising the exercise assembly 10—i.e., without consideration of the exercise footprint 30—then a hazardous situation may arise when the exercise assemblies are in use. This problem could arise in a home gym where a user installs an exercise assembly 10 too close to an obstacle, or it could arise in a fitness center where multiple exercise assemblies are being operated simultaneously in a confined space.

Furthermore, through experimentation and research, the inventor of the present application has recognized that prior art solutions for avoiding the above-mentioned problems have been insufficient. For example, prior art solutions have included the use of mats and/or frame extension members intended to increase the safety of an exercise assembly 10 by providing guidelines for proper spacing during installation and by preventing passersby from venturing too close to the exercise assembly 10 while it is in use. However, these items may not be visible enough to passersby and thus may not provide adequate warning. Additionally, these mats and frame extension members may get left off of the machines during installation, or removed thereafter, since they are not permanently attached to the machine itself.

Accordingly, the inventor has recognized a need for a method and system for demarcating a sufficient area for safe use of an exercise assembly. In the solution provided by the inventor and disclosed herein, an exercise footprint of an exercise assembly is indicated on a floor surface using illumination. The exercise footprint 30 is a 2D area on the floor surface representing the 3D space necessary for safe use of the exercise assembly, which may be the 3D space occupied by the exercise assembly 10 and the user while the exercise assembly 10 is in use. Referring to the example of FIGS. 1-3, the exercise footprint 30 is illuminated on the floor surface, which may be a floor 40 (FIG. 1) or a floor piece 36 (FIG. 2).

The exercise footprint 30 includes an area on the floor surface 36, 40 large enough to represent the motion of the exercise assembly 10 in use. Turning to FIG. 3, exercise members of the exercise assembly 10 move forward and back occupying an exercise footprint 30 having a length L on the floor surface 36, 40 which is longer than the extent of the length of the frame 12 from the front frame end 12*d* to the back frame end 12*e*. The length L of the exercise footprint 30 indicates the range of motion of the exercise members of the exercise assembly 10. In certain embodiments, the exercise footprint 30 may also include the range of motion of a user where the user's motion extends past or outside of the exercise assembly 10 or the footprint of the frame 12. In still other embodiments, the exercise footprint 30 may define an area on the floor surface 36, 40 needed to safely operate the exercise assembly 10. Thus, the exercise footprint 30 may extend outside the range of motion of the exercise members 43 of the exercise assembly 10 and/or the user to provide additional space to insure safety of a user and/or a passerby. For example, the exercise footprint 30 may be designed to provide guidance to a passerby regarding where not to walk, stand, or exercise on a floor 40 to avoid collision with the exercise assembly 10 or a user thereof. In such an embodiment, the exercise footprint 30 may be demarcated on the floor surface 36, 40 to account for the range of space occupied by the passerby, in addition to that of the exercise assembly 10 and the user thereof.

One or more illumination sources 34 are associated with the exercise assembly 10 to illuminate the floor surface 36, 40 to indicate at least a portion of the exercise footprint 30. In an embodiment, the illumination sources 34 may be incorporated into the exercise assembly, such as into one or more of the frame portions 12*a*-12*e*. The illumination sources 34 may be, for example, any device or system that focuses light onto a distinct boundary in order to demarcate the exercise footprint 30. In an exemplary embodiment, the illumination sources 34 may comprise one or more light emitting diodes (LEDs) or laser diodes configured to project light onto the floor surface 36, 40 in order to indicate some or all of the exercise footprint 30. For example, in the embodiment represented in FIG. 1, illumination sources 34 are incorporated into the bottom portion of the frame 12*c* and arranged to project light onto the floor surface 36, 40 to illuminate and demarcate the entire boundary of the exercise footprint 30. In other embodiments, the illumination sources 34 may be configured to illuminate only a portion of the exercise footprint 30 and the floor surface 36, 40. For example, FIG. 2 provides an embodiment having a front illumination source 34*a* that illuminates a front portion of the exercise footprint 30*a* and a rear illumination source 34*b* that illuminates a rear portion of the exercise footprint 30*b*.

The illumination source 34 that illuminates the exercise footprint 30, or at least a portion thereof, may be incorporated into a body of the exercise assembly 10 (such as in the embodiment of FIG. 1) or incorporated into an accessory or attachment to the exercise assembly 10. As shown in the example of FIG. 2, the illumination source 34 may be incorporated into a floor piece 36 and configured to cover at least a portion of the exercise footprint 30. For example, the floor piece 36 may comprise an extension member 32 configured to connect to the bottom portion of the frame 12*c* to effectively extend the frame out to cover at least a portion of the exercise footprint 30. Alternatively or additionally, the floor piece 36 may comprise a mat 37 configured to cover at least a portion of the exercise footprint 30. The floor piece 36 should be configured to provide or enable illumination of at least a portion of the exercise footprint 30. In FIG. 2, the front portion of the exercise footprint 30*a* is illuminated by illumination source 34*a* fixed to the exercise assembly 10 and projecting light onto the extension member 32. The extension member 32 may extend from front frame portion 12*b* to extend past the front frame end 12*d*. The extension member 32 may have a reflective portion 38 configured to reflect light from the illumination source sufficiently that the light can be seen on the extension member 32. The reflective portion 38 may have a reflective material thereon, such as a flexible reflective fabric or paint. In other embodiments, the reflective portion 38 may be any material that reflects light emitted from the illumination source 34 sufficiently to provide a visible indication of the exercise footprint 30.

In other embodiments comprising a floor piece 36, a mat 37 has an illumination source incorporated therein. For example, a mat 37 may have embedded LEDs or laser diodes providing indication of the exercise footprint 30. Alternatively or additionally, the mat 37 may incorporate fiber optic cabling demarcating the exercise footprint 30. In the example of FIG. 2, the rear end of the exercise footprint 30*b* is illuminated by one or more illumination sources 34*b* embedded into the mat 37 that extends from the back end of the frame 12*e*.

The illumination source 34 may be powered by the power source 41 of the exercise assembly 10. For example, the exercise assembly 10 may be powered by alternating-current (ac) electric power, for example from a wall socket. In such an embodiment, the illumination source 34 may be powered through circuitry in the exercise assembly 10. Alternatively or additionally, the exercise assembly 10 may be powered by user-generated motion, for example by a power-generating resistance device that utilizes the exercise motion and energy provided by the user to power the components of the exercise assembly 10. Examples of such systems are known in the art, such as that provided in U.S. Pat. No. 6,084,325 which has been incorporated herein by reference.

In some embodiments, the control unit 45 may control the illumination source 34 to adjust the illumination of the exercise footprint 30 according to changes in movement of the exercise members 43. For example, the control unit 45 may adjust the range of movement of one or more of the exercise members 43, for example in response to inputs from the user through the exercise console 28. The one or more illumination sources 34 may then be adjusted to adjust the indication of the exercise footprint 30 according to the change in the exercise footprint 30. Alternatively or additionally, the one or more illumination sources 34 may indicate movement of an exercise member 43 or a user on the exercise assembly 10. For example, in the embodiment of FIGS. 1-3, an illumination source may illuminate the floor surface 36, 40 to indicate a path of movement of the elongated foot pedals 14 and coupler arms 22.

The one or more illumination sources 34 may further be configured to provide a "setup" footprint to ensure that sufficient area is provided for safe installation and use of the exercise assembly 10. In such an embodiment, the illumination sources 34 may illuminate the floor surface 36, 40 to provide the largest possible exercise footprint 30, or even a larger area, to ensure that sufficient space is provided for safe use of the exercise assembly 10. In still other embodiments, the one or more illumination sources 34 may be configured to provide additional information in addition to indicating the exercise footprint 30. For example, the exercise footprint 30, or a portion thereof, may be indicated by illumination displaying exercise metrics, logos, advertisements, or the like.

Figure 5:
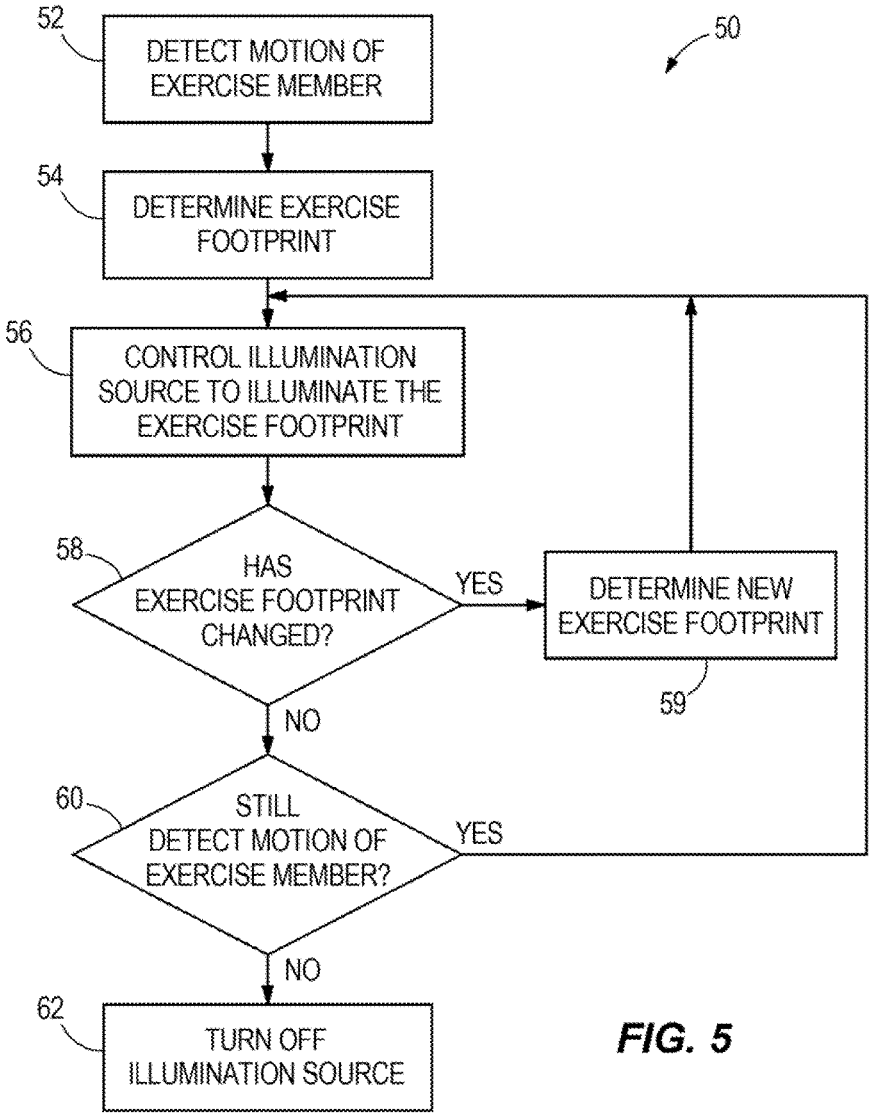
FIG. 5 is one embodiment of a method of indicating an exercise footprint.

FIG. 5 provides one embodiment of a method 50 of indicating an exercise footprint. At step 52, motion of an exercise member is detected. An exercise footprint is determined at step 54. The exercise footprint may be determined based on the motion of the exercise member. For example, the control unit 45 may determine an exercise footprint 54 based on the settings of the exercise assembly 10. For example, the control unit 45 may access a lookup table providing settings for the one or more illumination sources 34 based on the modes or settings in use for the exercise assembly 10, including stride length settings, tension settings, position settings, speed settings, exercise mode, or the like. At step 56, the control unit 45 controls one or more of the illumination sources 34 to illuminate at least a portion of the exercise footprint 30 on the floor surface 36, 40. At step 58, the control unit 45 detects changes in the exercise footprint 30, such as in response to a user input through the console 28. When changes in the exercise footprint 30 are detected at step 58, a new exercise footprint is determined at step 59, and the control unit returns to step 56 where it controls the illumination source 34 to indicate the new exercise footprint 30.

In some embodiments, the illumination 34 may indicate the exercise footprint 30 only while the exercise assembly 10 is in use. For example, the control unit 45 may activate the illumination source 34 upon detection of movement of one or more exercise members 43. In other embodiments, the control unit 45 may operate the illumination source 34 on a time schedule, such as during the operation hours of a fitness center. In still other embodiments, the control unit 45 may operate the illumination source 34 at all times when the exercise assembly 10 is operable.

In the embodiment of the method 50 depicted in FIG. 5, the control unit 45 detects motion of an exercise member 43 at step 60. While motion is detected, the control unit 45 continues to operate the illumination source 34 to indicate at least a portion of the exercise footprint 30. When motion is no longer detected at step 60, the control unit 45 turns off the illumination source at step 62.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A method of indicating an exercise footprint for an exercise assembly, the method comprising:

providing the exercise assembly having at least one exercise member movable by a user;

determining the exercise footprint for the exercise assembly, wherein the exercise footprint is a floor area representing a space occupied by the exercise member when the exercise member is moved by the user and a space occupied by the user while the user operates the exercise assembly, wherein the exercise footprint extends outside of a floor area occupied by a frame supporting the exercise assembly; and controlling at least one illumination source to illuminate a floor surface to indicate at least a portion of the exercise footprint that extends outside of the floor area occupied by the frame.

2. The method of claim 1 wherein the at least one illumination source is mounted to the exercise assembly and projects light onto the floor surface.

3. The method of claim 2 wherein the floor surface is a floor piece that reflects light from the illumination source mounted to the exercise assembly.

4. The method of claim 1 further comprising turning on the illumination source while the exercise assembly is being operated by a user, and turning off the illumination source when the exercise assembly is not being operated by a user.

5. The method of claim 4 further comprising turning on the illumination source upon movement of the exercise member by the user.

6. The method of claim 1 wherein the floor surface comprises a floor piece containing the illumination source.

7. The method of claim 1 wherein the step of illuminating the floor surface includes providing a light pattern on the floor surface within the exercise footprint that indicates the movement of the exercise member within the space occupied by the exercise member when the exercise member is moved by the user.

8. The method of claim 1 further comprising adjusting the illumination source to change the illumination on the floor surface to correspond with changes in the exercise footprint.

9. The method of claim 1 further comprising illuminating the floor surface to indicate an entire boundary of the exercise footprint.

10. The method of claim 1 wherein at least a portion of the exercise footprint that extends outside of the floor area occupied by the frame is defined by is defined by the space occupied by the user while the user operates the exercise assembly.

11. The method of claim 1 wherein at least a portion of the exercise footprint that extends outside of the floor area occupied by the frame is defined by the space occupied by the exercise member when the exercise member is moved by the user.

12. An exercise system that indicates an exercise footprint, the system comprising:

an exercise assembly including:

a frame, the frame occupying a floor area beneath the frame;

at least one exercise member that is movable by a user;

wherein the exercise footprint is a floor area representing the floor area beneath the frame and a space occupied the exercise member when the exercise member is moved by the user and a space occupied by the user operating the exercise assembly, wherein the space occupied by the exercise member extends outside of the floor area occupied by the frame of the exercise assembly; and an illumination source that illuminates a floor surface to indicate at least a portion of the exercise footprint defined by the space occupied by the exercise member that extends outside of the floor area occupied by the frame.

13. The system of claim 12 wherein the illumination source is mounted to the frame of the exercise assembly and projects light onto the floor surface.

14. The system of claim 13 wherein the illumination source includes at least one of an LED or a laser diode.

15. The system of claim 12 further comprising a floor piece positioned on and extending outside of the floor surface beneath the frame, the floor piece having the illumination source embedded therein.

16. The system of claim 12 further comprising a control unit that adjusts the illumination source to change the illumination on the floor surface in response to a change in the movement of the exercise member that changes in the exercise footprint.

17. The system of claim 12 wherein the illumination source receives power from the exercise assembly.

18. The system of claim 17 wherein the exercise assembly is powered by user-generated motion, and wherein the illumination source is only powered while the exercise assembly is being operated by a user.

19. The system of claim 12 wherein at least a portion of the exercise footprint that extends outside of the floor area occupied by the frame is further defined by the space occupied by the user while the user operates the exercise assembly; and wherein the illumination source illuminates the floor surface to indicate at least a portion of the exercise footprint defined by the space occupied by the user while the user operates the exercise assembly.

* * * * *